United States Patent [19]

Tuck et al.

[11] 4,417,173

[45] Nov. 22, 1983

[54] THERMIONIC ELECTRON EMITTERS AND METHODS OF MAKING THEM

[75] Inventors: Richard A. Tuck, Slough; Heather B. Skinner, London, both of England

[73] Assignee: E M I-Varian Limited, Hayes, England

[21] Appl. No.: 241,037

[22] Filed: Mar. 6, 1981

[30] Foreign Application Priority Data

Dec. 9, 1980 [GB] United Kingdom ..... 8039472

[51] Int. Cl.[3] ..... H01J 1/14

[52] U.S. Cl. ..... 313/346 R; 313/346 DC

[58] Field of Search ..... 313/346 R, 346 DC

[56] References Cited

U.S. PATENT DOCUMENTS 2,509,702 5/1950 Stanier ..... 313/346 DC 2,899,592 8/1959 Coppola ..... 313/346 R 3,373,307 3/1968 Zalm et al. ..... 313/346 R 4,165,473 8/1979 Falce ..... 313/346 R

FOREIGN PATENT DOCUMENTS 19992 12/1980 European Pat. Off. .

*Primary Examiner*—Harold Dixon

*Attorney, Agent, or Firm*—Fleit, Jacobson, Cohn & Price

[57] ABSTRACT

A thermionic cathode (FIG. 1) comprises a porous matrix of tungsten (4) impregnated with alkaline earth activator.

A coating (5) 1 μm thick is formed on the matrix (4). The coating is of σ phase alloy of molybdenum and osmium.

Alternative σ phase alloys are disclosed, and various methods of making cathodes are disclosed.

14 Claims, 5 Drawing Figures

THERMIONIC ELECTRON EMITTERS AND METHODS OF MAKING THEM

Figure 1:
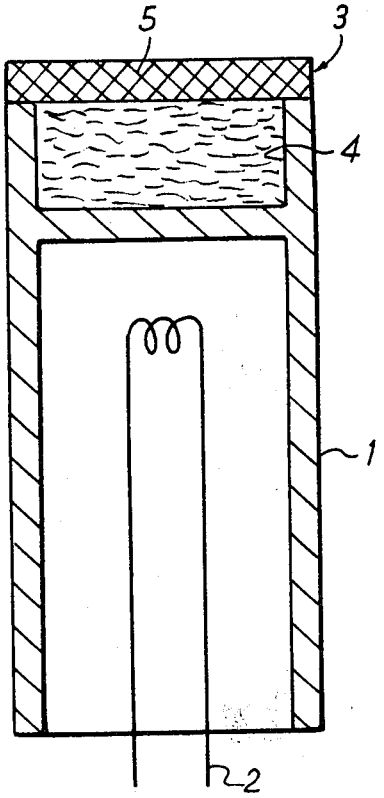

The present invention relates to thermionic electron emitters and methods of making them.

A thermionic cathode known as the 'M' type is disclosed in U.S. Pat. No. 3,373,307. This cathode is a dispenser cathode which comprises a refractory metal matrix of tungsten (W) or tungsten and molybdenum in reactive relationship with an alkaline earth activator which supplies free barium oxide to the emitting surface of the matrix. A thin porous coating of a refractory metal having a work function higher than that of tungsten covers the emitting surface.

The preferred metal is osmium (Os) although it could be iridium, ruthenium or rhenium or simple substitutional alloys of them.

In an article entitled 'Tracer Study of the Decrease of Emission Density of Osmium-Coated Impregnated Cathodes' the end of the functional life of an osmium, tungsten 'M'-type cathode is associated with the formation of an intermetallic $OsW_2$ compound.

U.S. Pat. No. 4,165,473 (Louis R. Falce—Varian Associates Inc.) discloses a different type of cathode herein referred to as 'mixed-matrix' type. A preferred example of it comprises particles of pure iridium mixed in fixed proportions with particles of pure tungsten, and impregnated with activator.

The iridium and tungsten form an alloy 'but it is believed that optimum results require the alloying to be incomplete'. The emission of such a cathode is comparable with that of the 'M' type. The optimum proportions are 20% iridium and 80% tungsten.

The iridium may be replaced by osmium, ruthenium or a mixture thereof, and the tungsten may be replaced by molybdenum. The replacements of iridium are in the same proportion as the iridium.

The European application having publication number 19992 (EMI-Varian Ltd) (published Dec. 10, 1980) discloses various cathodes, a preferred example having a tungsten or molybdenum substrate impregnated with activator and an emissive surface comprising a thin coating of 20% osmium fully alloyed with 80% tungsten. Alternatives for the osmium such as iridium, ruthenium, rhenium or rhodium are disclosed. The proportions of the replacements are stated to be the same as for osmium. The application suggests a theory explaining the operation of the disclosed cathodes. Briefly, in terms of barium oxide (BaO), and osmium Os, the theory postulates that BaO reacts with Os to form 'Osmate' type compounds and that by controlling the chemical potential of the osmium, the optimum compound for emission is produced.

According to one aspect of the present invention, there is provided a thermionic electron emitter comprising: at least an emissive surface layer predominantly of an atomically rough (as hereinafter defined) alloy, taken from the group of alloys comprising:

| | | |
|---|---|---|
| Mo/Os | 55–34% Mo | 45–66% Os |
| Ir/Ta | 17–48% Ir | 83–52% Ta |
| W/Re | 54–25% W | 46–75% Re |
| Nb/Rh | 69–48% Nb | 31–52% Rh |
| Nb/Ir | 34–20% Nb | 66–80% Ir |
| Rh/Ta | 15–36% Rh | 85–64% Ta |

and an alkaline earth activator.

According to another aspect of the invention, there is provided a method of making a thermionic electron emitter in which: an atomically rough (as hereinafter defined) alloy of the group comprising:

| | | |
|---|---|---|
| Mo/Os | 55–34% Mo | 45–66% Os |
| Ir/Ta | 17–48% Ir | 83–52% Ta |
| W/Re | 54–25% W | 46–75% Re |
| Nb/Rh | 69–48% Nb | 31–52% Rh |
| Nb/Ir | 34–20% Nb | 66–80% Ir |
| Rh/Ta | 15–36% Rh | 85–64% Ta |

and an alkaline earth activator are brought together so that the activator activates the alloy, and the alloy forms at least a predominant part of an emissive surface layer of the emitter.

Preferably $\sigma$ phase alloys are used. The constituents of the $\sigma$ phase alloys are as follows:

| | | |
|---|---|---|
| Mo/Os | 54–44% Mo | 46–56% Os |
| Ir/Ta | 17–38% Ir | 83–62% Ta |
| W/Re | 54–35% W | 46–65% Re |
| Nb/Rh | 69–58% Nb | 31–42% Rh |
| Nb/Ir | 29–25% Nb | 71–75% Ir |
| Rh/Ta | 15–26% Rh | 85–74% Ta |

The percentages are all weight percent. In U.S.A. Nb (Niobium) is known as Cb (Columbium). By "atomically rough" we mean that in one layer of the atomic structure of the alloy the atoms have a spacing which is large compared to the spacing between that layer and its adjacent parallel layer.

Preferably, binary alloys as listed above are used. However, ternary alloys comprising the listed pairs of elements together with a third element with which any one of the pair also forms an atomically rough alloy could be used.

Many ways of producing the electron emitters are possible.

For example, a porous substrate of refractory material such as tungsten and/or molybdenum may be impregnated with activator, and then the alloy is formed on the substrate by co-sputtering or by vapour deposition, of the constituents of the alloy onto the substrate.

The alloy may, in some cases, be formed by co-precipitating the constituents on the substrate from chemically reducible compounds of the constituents.

As another example, a mixture of the powdered constituents of the $\sigma$ phase alloys in the requisite proportions for $\sigma$ phase is pressed and sintered in known manner to give a porous matrix, furnaced at a temperature and for a time required to ensure full alloying and then impregnated with the activator. Alternatively, a powder of fully alloyed $\sigma$ phase alloy may be pressed and sintered to produce a porous matrix and then impregnated with activator.

As only a surface layer of the cathode must be of $\sigma$ phase alloy, the $\sigma$ phase alloy powder or constituents may be placed on a layer of tungsten and/or molybdenum powder before pressing and sintering to form the matrix.

In a further possible method of making the emitters energetic ball milling techniques known as mechanical alloying similar to the techniques described in British Pat. Nos. 1298944 and 1265343 (Inco) may be used.

The alkaline earth activator preferably comprises barium oxide, calcium oxide and aluminium oxide in conventional proportions. Various modifications to that activator are possible however. For instance instead of calcium oxide, another oxide of an alkaline earth metal other than barium may be used, and instead of aluminium oxides there may be used boron oxide. The metal other than barium may be strontium or magnesium or a mixture of any two or more of calcium, strontium and magnesium. Furthermore carbonates of calcium, strontium and/or magnesium may be used instead of the oxides.

It is thought that the electron emitters according to the present invention operate in the manner described hereinafter although this is not proven. The explanation is given in terms of barium oxide, and $\sigma$ phase molybdenum/osmium alloy forming a surface film on a porous tungsten substrate.

Consider first an 'M' type cathode comprising a porous tungsten substrate and a pure osmium emissive layer. Barium oxide diffuses over the surface of the osmium and forms a monatomic layer thereon.

Because the osmium has a higher work function than the barium oxide, the barium oxide orients into dipoles with barium uppermost and consequently produces a lower work function surface.

It is also believed that the coverage of the surface of the alloy with barium oxide affects the work function. If the dipole density on the surface increases too much, mutual depolarisation occurs, increasing the work function.

The $\sigma$ alloy has an open tetragonal structure with a number of hexagonal or pentagonal depressions per unit cell depending on the crystal face exposed providing interstitial sorption sites for the barium oxide. In other words, it has an open structure into which the barium oxide dipoles fit surrounded by regions where barium oxide would have a low heat of sorption. This controls the spacing of the dipoles thus controlling the coverage of the surface. It is believed that the coverage of the surface of the alloy with the barium oxide film responsible for the low work function is substantially less than the coverage of a pure osmium surface.

Thus, ideally, the dipoles should be evenly spaced over the whole surface, being spaced sufficiently to reduce depolarisation effects.

Because different crystal planes of the $\sigma$ phase structure provide differently configured interstitial sites, it is thought that some crystal planes will provide a lower work function than others by providing a coverage which is closer to the optimum coverage.

Figure 2:
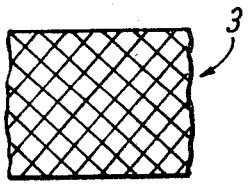
Figure 3:
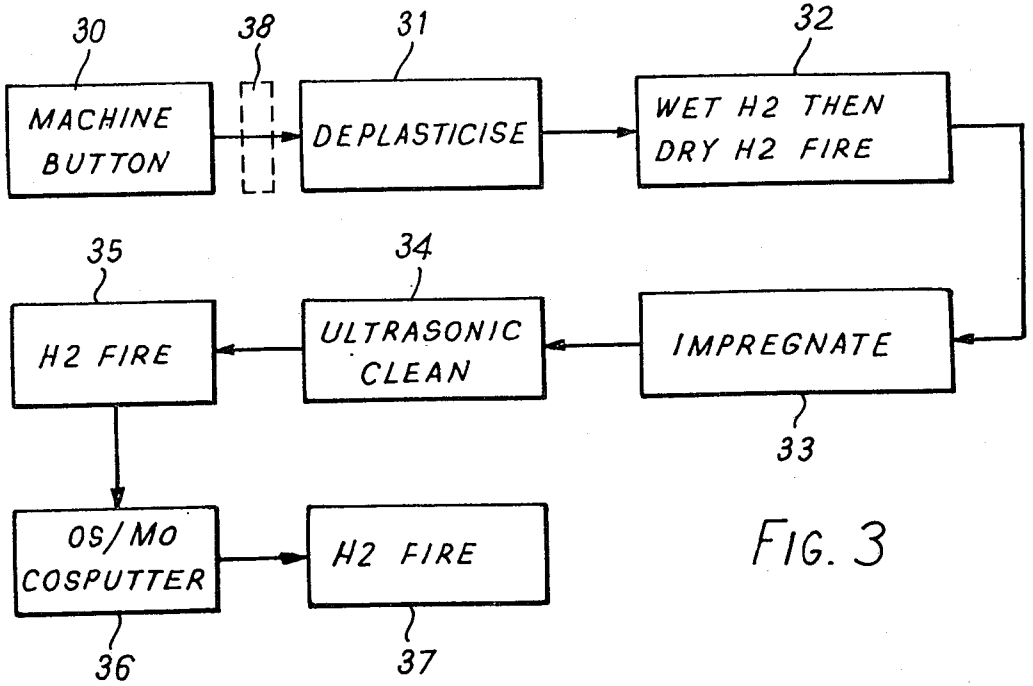
Figure 4B:
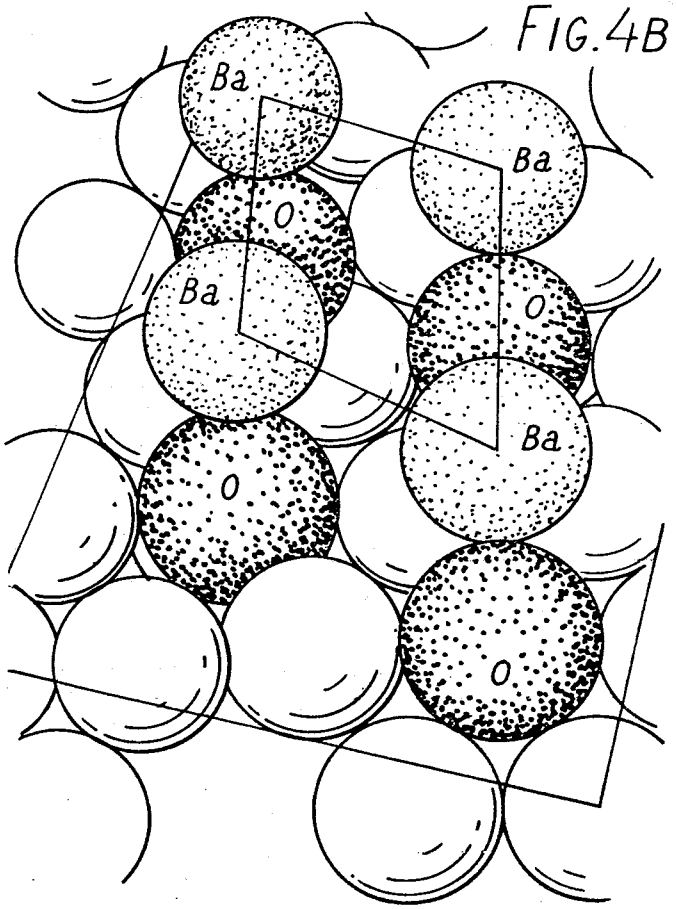
Figure 4A:
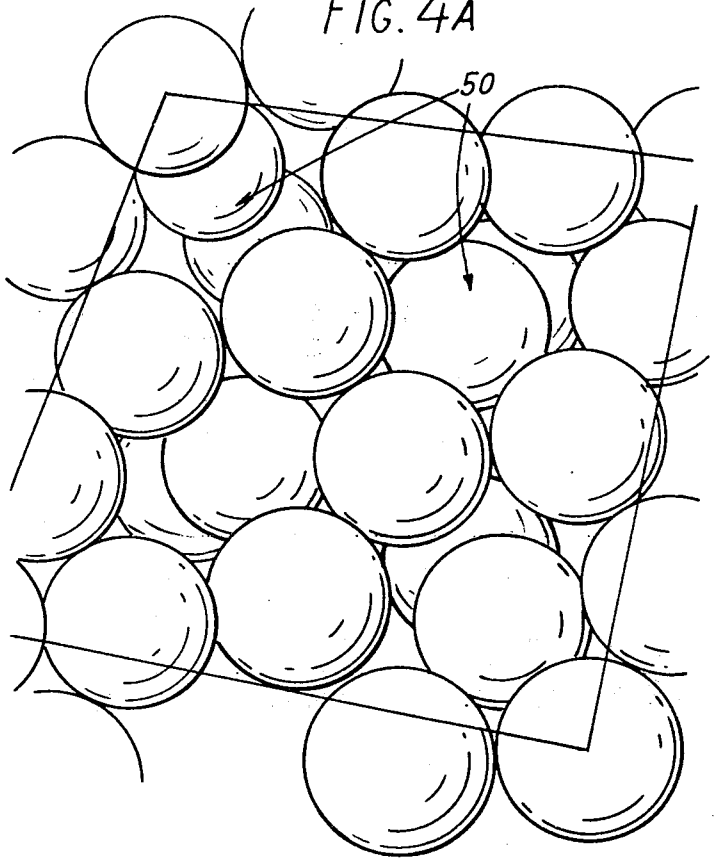

For a better understanding of the present invention, reference will now be made, by way of example, to the accompanying drawings, in which:

FIG. 1 is a section through a preferred thermionic cathode in accordance with the invention, FIG. 2 shows part of another cathode in accordance with the invention, FIG. 3 is a schematic diagram of a method of manufacturing the cathode of FIG. 1, and FIGS. 4A and B show the structure of a part of the surface layer of a cathode in accordance with the invention.

Referring to FIG. 1, the cathode comprises a molybdenum tube 1 containing in a lower cavity a heater 2, and in an upper cavity a thermionic emitter 3. The emitter 3 comprises a porous matrix 4 of tungsten impregnated with an activator in the form of a mixture of barium oxide, aluminium oxide, and calcium oxide in the molecular proportions 3:1:½ respectively, and a coating 5 on the free surface of the matrix.

In accordance with the invention, in this example thereof, the coating 5 comprises a fully alloyed $\sigma$ phase alloy of osmium and molybdenum having the proportions of about 46 to 56 wt % osmium and 54 to 44 wt % molybdenum. $\sigma$ phase alloys are known and are described, for example, in a review article "The Sigma Phase Metallurgical Reviews" 1966 Vol. 11 p. 61–87.

The coating in this example is formed by co-sputtering osmium and molybdenum in the desired proportions onto the impregnated matrix. The coating is preferably about 1 μm thick in this example, but it may have a thickness in the range 2000Å to 2 μm.

In more detail, an illustrative method of making the emitter of FIG. 1 is as follows, referring to FIG. 3.

A porous matrix of tungsten is impregnated with filler e.g. a plastics material to enable it to be machined (30) and then the filler is at least partially removed by firing in air (31). The button is then subjected to wet hydrogen at a temperature of 1000° to remove (by oxidation) remnants of the filler followed by dry hydrogen at 1800° C. to produce reducing conditions (32). The matrix is then impregnated with activator, e.g. barium calcium aluminate (33), cleaned ultrasonically (34) and fired in a hydrogen atmosphere at a temperature of e.g. 1000° C. for e.g. 2 to 5 minutes (35). A layer of osmium and molybdenum in the proportions to form the $\sigma$ phase alloy layer of about 46 to 56 wt % osmium and 54 to 44 wt % molybdenum, corresponding to layer 5 of FIG. 2 is then co-sputtered onto the matrix (36). Finally the matrix with the layer is fired in hydrogen at 1300° C. to form the $\sigma$ phase alloy (37). Optionally, the button is polished with a final polish using ¼ μm diamond paste to give a smooth surface before the alloy is sputtered onto the polished surface. In practice, the polishing step (38) would take place on the machined button before it is deplacticised.

Instead of co-sputtering, the coating may be formed by co-evaporating the metals osmium and molybdenium onto the matrix 4. This is done by directing electron beams onto targets of osmium and molybdenum to cause the metals to evaporate from the targets onto the matrix in the correct proportion. The coating could also be formed by co-precipitating the metals onto the matrix from reducible compounds thereof.

In another cathode in accordance with the invention, (FIG. 2) the whole emitter 3 comprises a $\sigma$ phase alloy of osmium and molybdenum in the approximate proportions 46 to 56 wt % osmium and 54 to 44 wt % molybdenum, impregnated with an alkaline earth aluminate activator. The emitter of FIG. 2 is made for example by:

(i) pressing a mixture of the powdered metals in the desired proportions;

(ii) sintering to give a 20% porous matrix;

(iii) furnacing at a temperature and for a time to enable full osmium/molybdenum interdiffusion to occur during furnacing, and (iv) impregnating the resultant porous matrix with alkaline earth aluminate, for instance barium oxide, aluminium oxide and calcium oxide in the molecular proportions 3:1:½ respectively.

An alternative method of making the emitter of FIG. 2 comprises:

(i) pressing powder of $\sigma$ phase alloy of osmium/molybdenum having the approximate proportions of 46 to 56 wt % osmium and 54 to 44 wt % molybdenum;

(ii) sintering to give a 20% porous matrix; and (iii) impregnating the resultant porous matrix with alkaline earth aluminate, for instance barium oxide, aluminium oxide and calcium oxide in the molecular proportions 3:1:½ respectively.

Another alternative method of making the emitter of FIG. 2 is to use energetic mechanical alloying techniques as described in British Pat. Nos. 1298944 and 1265343 (Inco) to form the σ phase alloy, followed by forming a porous matrix and impregnation with activator.

The impregnant may have the form described hereinbefore but in other proportions such as 4:1:1 or 5:2:3. Furthermore, instead of calcium oxide, another oxide of an alkaline earth metal other than barium may be used, and instead of aluminium oxide there may be used boron oxide. The metal other than barium may be strontium or magnesium or a mixture of any two or more of calcium, strontium and magnesium. Furthermore, instead of oxides of the alkaline earth metal other than barium, compounds which decompose on heating to oxides e.g. carbonates of those metals may be used.

Although it is not yet proven, it is believed that at least a cathode as described with reference to FIG. 1, with a co-sputtered σ phase alloy surface 5 has a surface as shown in FIGS. 4A and B.

The σ phase alloy has an open tatragonal structure and the free surface of the alloy layer comprises principally molybdenum. The σ phase alloy has an atomically rough surface (as hereinbefore defined). The σ phase structure provides interstitial sites 50 (FIG. 4A) into which the oxygen atoms of the barium oxide fit (FIG. 4B). Thus the coverage of the surface by the barium oxide is controlled.

Because different crystal planes of the σ phase structure provide differently configured interstitial sites, it is thought that some crystal planes will provide a lower work function than others by providing a coverage which is closer to the optimum. Co-sputtering of the alloy film 5 in the cathode of FIG. 1 or 2 appears to favour a particular crystal plane, which produces a cathode with a narrow work function distribution.

Although examples of the invention have been described with reference to σ phase molybdenum/osmium alloy, other σ phase alloys which are stable at cathode operating temperatures may be used. Such σ phase alloys are:

| | | |
|---|---|---|
| Mo/Os | 54–44% Mo | 46–56% Os |
| Ir/Ta | 17–38% Ir | 83–62% Ta |
| W/Re | 54–35% W | 46–65% Re |
| Nb/Rh | 69–58% Nb | 31–42% Rh |
| Nb/Ir | 29–25% Nb | 71–75% Ir |
| Rh/Ta | 15–26% Rh | 85–74% Ta |

The percentages are all weight percent. In U.S.A. Nb (Niobium) is known as Cb (Columbium).

Cathodes incorporating such alloys may be made in the ways described above by way of example.

The above listed proportions may be departed from to the extent shown in the following list, the proportions being those at or near cathode operating temperatures.

| | | |
|---|---|---|
| Mo/Os | 55–34% Mo | 45–66% Os |
| Ir/Ta | 17–48% Ir | 83–52% Ta |
| W/Re | 54–25% W | 46–75% Re |
| Nb/Rh | 69–48% Nb | 31–52% Rh |
| Nb/Ir | 34–20% Nb | 66–80% Ir |
| Rh/Ta | 15–36% Rh | 85–64% Ta |

Thus in some of the listed cases, alloys other than σ phase may be used. However, these other alloys have a feature in common with σ phase, that is they are atomically rough alloys as hereinbefore defined.

Furthermore, σ phase ternary alloys comprising the listed pairs of elements alloyed together with a third element which forms a σ phase alloy which is stable at cathode operating temperatures with one of the pair of elements may be used.

What we claim is:

1. A thermionic electron emitter comprising at least an emissive surface layer formed predominantly of a σ phase alloy selected from the group of σ phase alloys consisting of:

| | | |
|---|---|---|
| Mo/Os | 54–44% Mo | 46–56% Os |
| Ir/Ta | 17–38% Ir | 83–62% Ta |
| W/Re | 54–35% W | 46–65% Re |
| Nb/Rh | 69–58% Nb | 31–42% Rh |
| Nb/Ir | 29–25% Nb | 71–75% Ir |
| Rh/Ta | 15–26% Rh | 85–74% Ta |

and an alkaline earth activator.

2. An emitter according to claim 1 wherein the alloy is a binary alloy.

3. An emitter according to claim 2 comprising a substrate of tungsten and/or molybdenum impregnated with said alkaline earth activator, said emissive surface layer being formed on said substrate.

4. An emitter according to claim 3 wherein said layer has a thickness in the range 2000Å to 2 μm.

5. An emitter according to claim 3 wherein said layer has a thickness of 1 μm.

6. An emitter according to claim 2 wherein said emissive surface layer is a porous matrix which is impregnated with said alkaline earth activator.

7. A thermionic electron emitter comprising at least an emissive surface layer predominantly of an alloy taken from the group of alloys

| | | |
|---|---|---|
| Mo/Os | 55–34% Mo | 45–66% Os |
| Ir/Ta | 17–48% Ir | 83–52% Ta |
| W/Re | 54–25% W | 46–75% Re |
| Nb/Rh | 69–48% Nb | 31–52% Rh |
| Nb/Ir | 34–20% Nb | 66–80% Ir |
| Rh/Ta | 15–36% Rh | 85–64% Ta |

and an alkaline earth activator, the atoms in one layer of the atomic structure of said alloy having a spacing which is large compared to the spacing between that layer and its adjacent parallel layer.

8. An emitter according to claim 7, wherein the alloy is a binary alloy.

9. An emitter according to claim 8, wherein the alloy comprises 54 to 44% molybdenium and 46 to 56% osmium.

10. An emitter according to claim 8, wherein the alloy comprises 54 to 35% tungsten and 46 to 65% rhenium.

11. An emitter according to claim 8, comprising a substrate of tungsten and/or molybdenum impregnated with the activator, the said alloy being a layer on the substrate.

12. An emitter according to claim 11 wherein the said layer has a thickness in the range 2000Å to 2 μm.

13. An emitter according to claim 11 wherein the said layer has a thickness of 1 μm.

14. An emitter according to claim 8, wherein the alloy forms a porous matrix and is impregnated with the activator.

* * * * *